US009340980B2

(12) United States Patent
Walters

(10) Patent No.: US 9,340,980 B2
(45) Date of Patent: May 17, 2016

(54) GUTTER BUMPER

(71) Applicant: Senox Corporation, Austin, TX (US)

(72) Inventor: Arnold Bruce Walters, Austin, TX (US)

(73) Assignee: Senox Corporation, Austin, TX (US)

( * ) Notice: Subject to any disclaimer, the term of this patent is extended or adjusted under 35 U.S.C. 154(b) by 0 days.

(21) Appl. No.: 13/898,970

(22) Filed: May 21, 2013

(65) Prior Publication Data

US 2014/0346300 A1 Nov. 27, 2014

(51) Int. Cl.
*E04D 13/064* (2006.01)
*E04D 13/072* (2006.01)

(52) U.S. Cl.
CPC ..... *E04D 13/0727* (2013.01)

(58) Field of Classification Search
CPC ..... E04D 13/072; E04D 13/0722; E04D 13/0725; E04D 13/0727
USPC ..... 248/48.1, 48.2; 52/11, 12
See application file for complete search history.

(56) References Cited

U.S. PATENT DOCUMENTS

| | | | | | |
|---|---|---|---|---|---|
| 2,536,704 | A * | 1/1951 | Shea et al. | 248/48.2 |
| 2,710,159 | A * | 6/1955 | Gordon | 248/48.2 |
| 2,739,775 | A * | 3/1956 | Bertram | 248/48.1 |
| 2,801,601 | A * | 8/1957 | Riedel | 52/11 |
| 3,022,029 | A * | 2/1962 | Blayden | 248/48.2 |
| 3,053,491 | A * | 9/1962 | Ramser | 248/48.2 |
| 3,333,803 | A * | 8/1967 | Landis | 248/48.2 |
| 3,630,473 | A * | 12/1971 | Landis | 248/48.2 |
| 3,752,428 | A * | 8/1973 | Trostle et al. | 248/48.2 |
| 3,913,284 | A * | 10/1975 | Hall | 52/11 |
| 4,043,527 | A * | 8/1977 | Franzmeier | 248/65 |
| 4,210,301 | A * | 7/1980 | Weiss | 248/48.2 |
| 4,294,422 | A * | 10/1981 | Odekirk | 248/48.2 |
| 4,432,518 | A * | 2/1984 | Navarre | 248/48.2 |
| 4,915,338 | A * | 4/1990 | Guth | 248/250 |
| 5,271,192 | A * | 12/1993 | Nothum et al. | 52/12 |
| 5,570,860 | A * | 11/1996 | Schoenherr | 248/48.2 |
| 5,884,876 | A * | 3/1999 | Axford | 248/48.2 |
| 6,209,826 | B1 * | 4/2001 | Pratt, Jr. | 248/48.2 |
| 6,254,039 | B1 * | 7/2001 | Zimmerman | 248/48.2 |
| 6,543,729 | B1 * | 4/2003 | Ylonen | 248/48.1 |
| 6,631,587 | B2 * | 10/2003 | Lynch | 52/11 |
| 6,726,155 | B1 * | 4/2004 | Zimmerman | 248/48.1 |
| 6,854,692 | B1 * | 2/2005 | Winkel | 248/48.1 |
| 6,935,074 | B2 * | 8/2005 | Gramling | 52/11 |
| 7,082,723 | B2 | 8/2006 | Gramling | |
| 7,530,200 | B2 * | 5/2009 | Gramling | 52/11 |
| 7,581,355 | B2 * | 9/2009 | Smith | 52/11 |
| 7,861,980 | B1 * | 1/2011 | Verbrugge et al. | 248/48.2 |
| 7,891,143 | B2 | 2/2011 | Gramling | |
| 7,958,677 | B2 | 6/2011 | Gramling | |
| 8,104,230 | B2 * | 1/2012 | Gramling | 52/12 |
| 8,510,999 | B2 | 8/2013 | Gramling | |
| 2011/0114800 | A1 | 5/2011 | Gramling | |

* cited by examiner

*Primary Examiner* — Kimberly Wood
(74) *Attorney, Agent, or Firm* — J. Scott Denko; Denko & Bustamante LLP

(57) ABSTRACT

A gutter wedge with improved performance comprising an attachment member and a support member is disclosed. The support member and the attachment member may comprise indentations that are capable of being nested. The configuration of the support member and the attachment member provide additional strength and stability with respect to known gutter wedges.

13 Claims, 4 Drawing Sheets

GUTTER BUMPER

BACKGROUND

Rain gutters are used to convey water from one place to another. When used on buildings, rain gutters collect and divert water shed from the roof to designated locations. With rain gutters, water that flows off of a roof can be kept away from the building's base or diverted for collection in storage tanks.

Water is a relatively heavy substance to convey, but rain gutters are typically made of lightweight materials such as aluminum. Accordingly, rain gutter mounting should accommodate these characteristics. Moreover, rain gutters are useful for many types of buildings, yet buildings may have different roof configurations depending on the various contributions from roof material and fascia boards, for example, which can affect overhang, angle and depth. Rather than create custom gutters for each type of roof, brackets and adapters can be used to mount common rain gutters with varied roof types and configurations.

Many rain gutters are configured so that the roof-lacing side of the gutter should be perpendicular to the ground. Yet fascia sometimes hangs below the literal perimeter of the roof an insufficient distance to support the entire rear wall of a rain gutter and if the gutter is fully weighted with water, or the fascia is not perpendicular, the gutter can be bent downward by the water weight or there can be a gap between the gutter, and, the fascia. When bent, or poorly supported, a rain gutter will lose its effectiveness. Because the amount of this bend can be proportional to the amount of water conveyed, the gutter will lose effectiveness when it is most needed. Further, such deformation persists after the loading that caused the bend was applied.

The problem of gaps between a rain gutter and its fascia as well as minimization of water weight induced deformation can be ameliorated using gutter wedges. A gutter wedge prevents the gutter from bending towards the roof fascia when fully laden with water and it helps the gutter avoid deformation from water weight. However, prior gutter wedges required either complicated machining or expensive fabrication processes or imprecise measurements.

For example, a T-wedge is a type of gutter wedge made from a stiff extruded inelastic material with a protrusion that is difficult to fabricate and fashion to fit its application. They include a protrusion intended to fill the gap between the rain gutter and the fascia. Because this protrusion is substantially perpendicular to the rain gutter, it is necessarily not perpendicular to a fascia that made the use of a gutter wedge necessary. It is also expensive to fabricate. In order to account for different fascia and potential gutter deformation, a sufficiently large T-wedge must be purchased and then shortened to match the actual slant of the particular fascia.

Another type of gutter wedge is a triangle wedge. It may involve a single piece of metal that has been bent to form a hollow, right-angled, triangular prism with two open sides. The short side of the triangle and its hypotenuse are the open sides with the third and closed side being adjacent to the gutter. In theory, the hypotenuse is perfectly straight, parallel to a roof fascia, and in constant contact with the roof fascia. In practice, standard size triangles are purchased and then shortened to match the actual angle between the gutter and the roof fascia. Because an entire side must be cut, it is difficult to make this cut perfectly straight and precisely match the angle of the roof. Because the contact with the roof will be controlled by the highest points on the edge, the precise contact locations with the roof may not be knowable in advance.

These contact points will be the sole resistance to lateral motion. This may cause additional problems in situations where the roof fascia is not uniform over the contact region.

Because of the problems associated with existing gutter wedges, there is a need for gutter wedges with improved performance, easier adjustability, and greater stability that can be fabricated at reasonable expense with readily managed materials.

SUMMARY OF THE INVENTION

A gutter wedge with improved performance comprising an attachment member and a support member is disclosed. The support member and the attachment member may comprise indentations that are capable of being nested. The configuration of the support member and the attachment member provide additional strength and stability over known gutter wedges.

DETAILED DESCRIPTION

This disclosure can be understood in the context of the following example. However, what follows is merely an example and is not intended to define the scope of this patent, which is defined by the claims.

Figure 1:
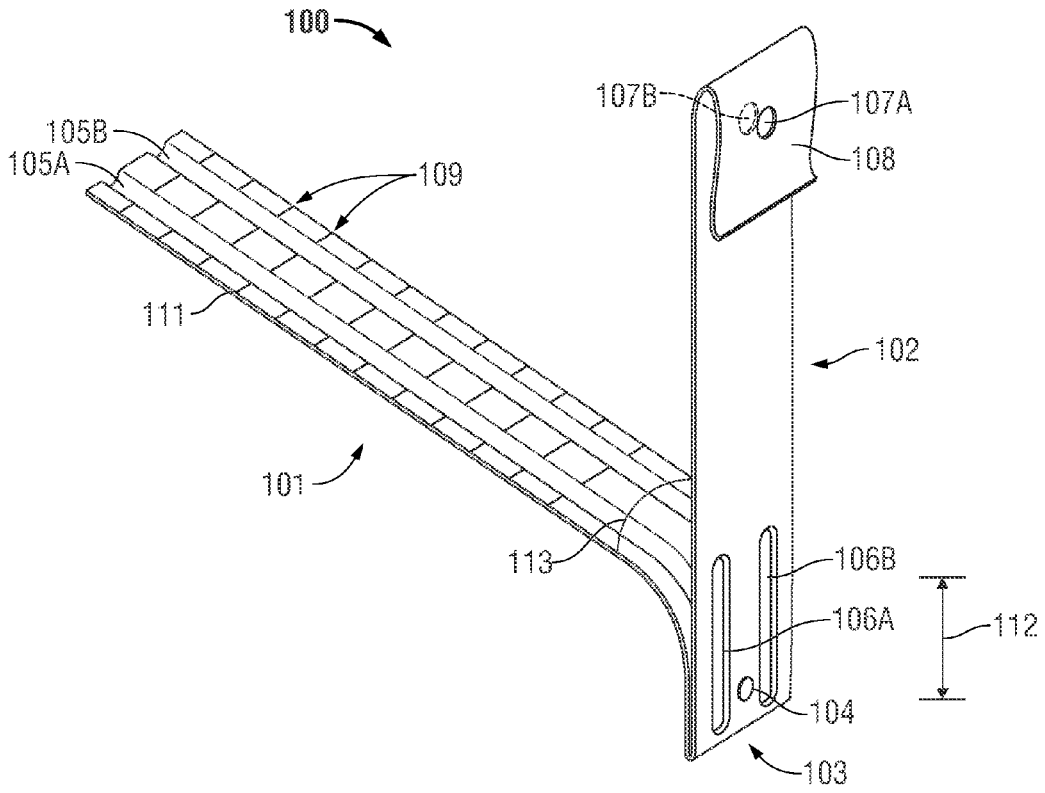
FIG. 1 illustrates a profile of an embodiment of a gutter wedge with improved performance.

FIG. 1 illustrates the profile of an embodiment of a gutter wedge with improved performance 100 (also known as a Gutter Bumper™). Gutter wedge 100 is generally comprised of elastic materials which may include, but are not limited to, steel, spring steel, steel alloys, aluminum, copper or plastics of a variety of types. Element 101 is the support member of gutter wedge 100 and is the portion that generally spans the gap between the rain gutter and the corresponding roof fascia. Attachment member 102 is generally parallel with the roof-facing side of a rain gutter. Support member 101 and attachment member 102 may be part of a single sheet that has been folded. Alternatively, multiple sheets of metal can be combined to form gutter wedge 100.

The embodiment shown in FIG. 1 is based on folding a single sheet of an elastic metal at attachment edge 103 to form support member 101 and attachment member 102. Support member 101 is also bent away from attachment member 102 at a distance 112 away from attachment edge 103 to produce an angle 113 between support member 101 and attachment member 102. Attachment point 104 in this embodiment prevents the two members from unfolding at attachment edge 103. Note that in the depicted embodiment, along distance 112, support member 101 and attachment member 102 are coincident. Support member 101 includes a support edge 111 and score markings 109. In the depicted embodiment, support member 101 further includes indentations 105A and 105B. Attachment member 102 also includes indentations 106A and 106B, holes 107A and 107B, and spring tension clip 108.

In the embodiment shown in FIG. 1, attachment edge 103 represents the location where a single sheet of metal has been folded to form support member 101 and attachment member 102. If support member 101 and attachment member 102 are not formed from a single sheet of metal, attachment edge 103 may represent the point where support member 101 and attachment member 102 are joined which may be effectuated by, for example, a tox or make use of other attachment technique as those of skill will recognize. If the lowest point of support member 101 and attachment member 102 are not the same, then attachment edge 103 would represent the lowest point where the two members substantially overlap.

Attachment point 104 represents a possible location and method for keeping support member 101 and attachment member 102 attached to each other. In the embodiment illustrated in FIG. 1, attachment point 104 represents a location in which the support member and attachment member have been stamped together. Attachment edge 103 may also serve as an attachment point 104 to the extent that it prevents the two members from separating from each other. In FIG. 1, attachment edge 103 is the location in which a sheet of metal has been folded and therefore also serves to hold the two members together. In this illustration, attachment point 104 holds the two members together and also prevents them from unfolding at attachment edge 103.

As illustrated in FIGS. 3A, 3B, 4A, and 4B, attachment point 104 may take the form of a circular indentation in members 101 and 102. Although illustrated as a single circle, attachment 104 could have any shape including, but not limited to, squares, ovals, and dashes. There could also be multiple 104 attachment points at different locations. Attachment 104 could also include various stamps or insignias. Attachment point 104 could be achieved via various attachment mechanisms, including stamping, riveting, or welding.

Figure 3B:
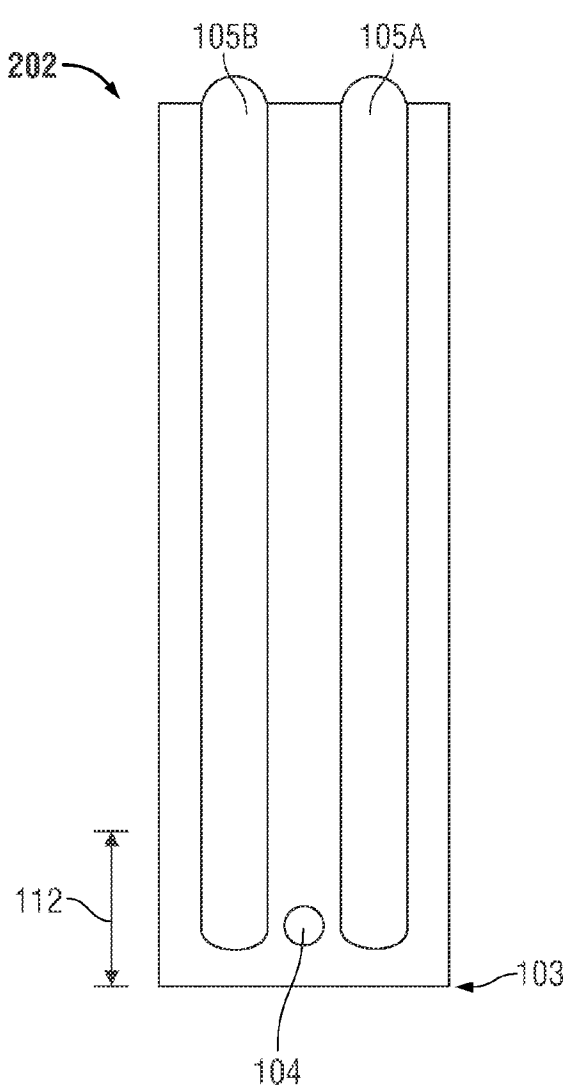
FIG. 3B illustrates the underside of a support member of an embodiment of a gutter wedge with improved performance.
Figure 3A:
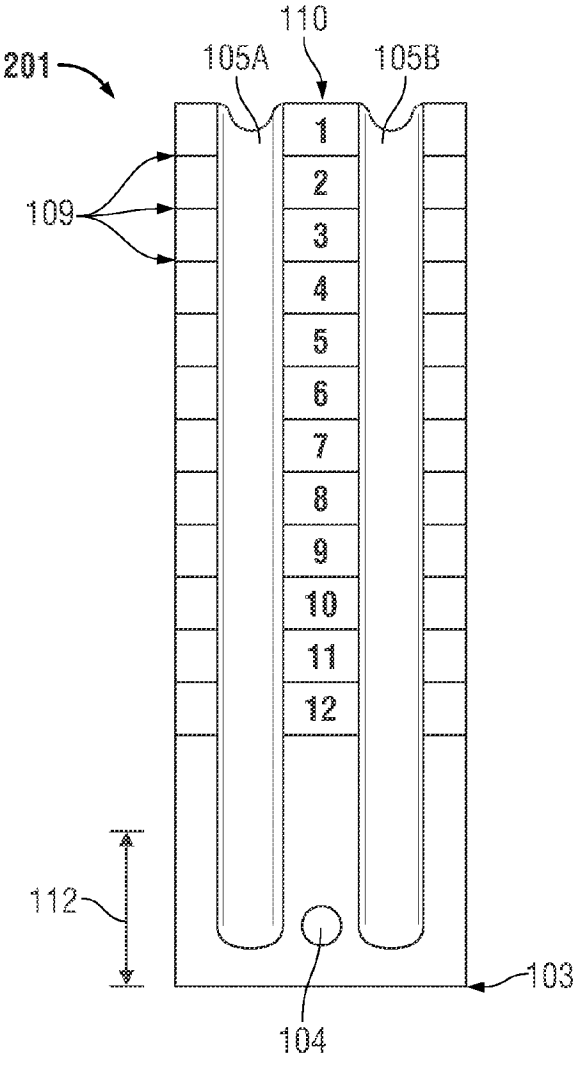
FIG. 3A illustrates the topside of a support member of an embodiment of a gutter wedge with improved performance.

FIGS. 3A and 3B illustrate opposite views of support member 101. Although FIG. 1 illustrates the support member 101 as being bent, FIGS. 3A and 3B illustrate support member 101 prior to being bent to form gutter wedge 100. FIG. 3A illustrates the topside or gutter side 201 of the support member 101. FIG. 3B illustrates the underside or roof side 202 of support member 101. Support member 101 includes indentations 105A and 105B. In FIG. 3A, the indentations are concave (i.e., curved away from the viewer), and in FIG. 3B, the indentations are convex (i.e., curved towards the viewer). If attachment point 104 is the result of stamping, then it may also be concave in FIG. 3A and convex in FIG. 3B. If attachment point 103 is the result of folding, the view from FIG. 3A represents the outside of the fold and the view from FIG. 3B represents the inside of the fold.

FIG. 3A, topside 201, illustrates score markings 109 and enumerations 110. Score markings 109 and enumerations 110 are concave (i.e., stamped into the material). However, these score marking and enumerations could also be achieved using other methods including stickers, decals, or laser etching. Score markings 109 could have various spacings that may or may not be uniform. In addition, enumerations 110 could comprise letters or other identifiers in place of or in combination with the numbers illustrated in FIG. 3A. In the embodiment shown in FIG. 3A, the support member 101 is scored across the entire flat portion of topside 201 using scores that are perpendicular to its short sides. The score markings 109 aid in cutting straight across the entire support member 101 to uniformly shorten it for use with various angles of fascia. The enumerations aid in repeatedly identifying the proper score in the event that many gutter wedges need to be cut to the same length.

FIG. 3B, underside 202, does not contain the markings and enumerations that are shown on the topside 201. However, as the underside of a rain gutter is its most visible portion, it may be desirable to avoid any extraneous markings, including on the underside 202 of gutter wedge 100. In addition, underside 202 may also be painted or otherwise coated to reduce its visibility. For example, the underside 202 of the support member 101 could be painted to match the underside of the associated rain gutter or the adjacent wall or fascia.

Figure 4B:
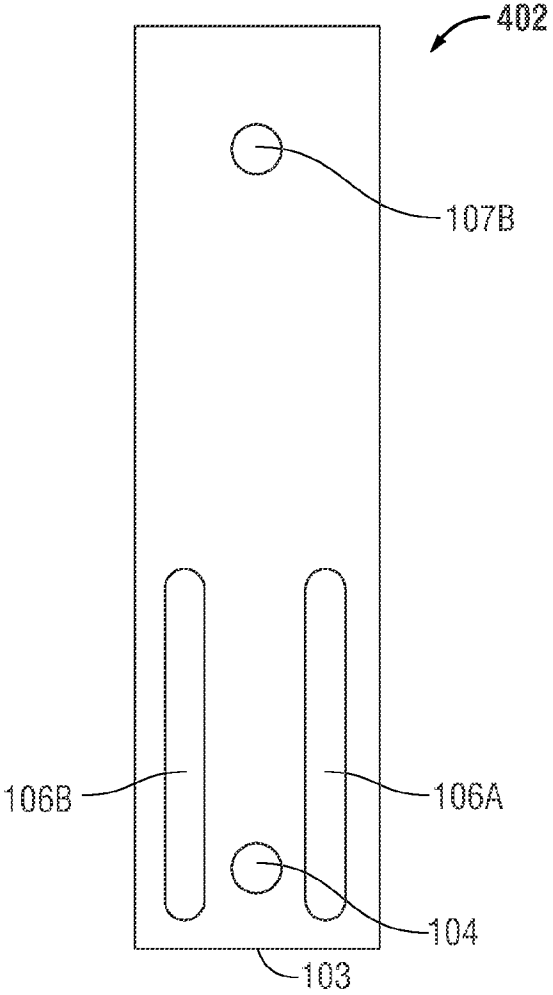
FIG. 4B illustrates the roof fascia side of an attachment member of an embodiment of a gutter wedge with improved performance.
Figure 4A:
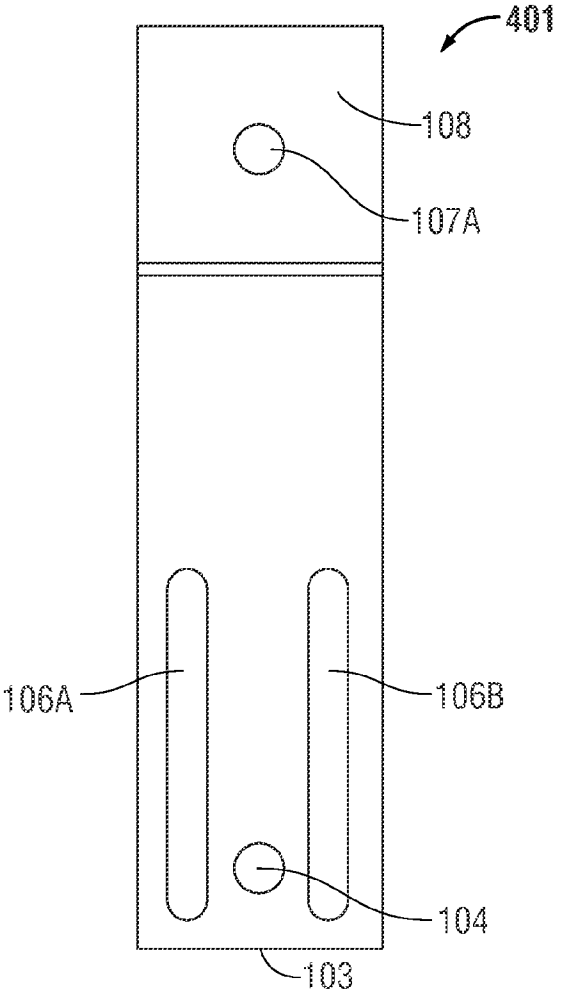
FIG. 4A illustrates the rain gutter side of an attachment member of an embodiment of a gutter wedge with improved performance.

FIGS. 4A and 4B illustrate opposite views of attachment member 102. FIG. 4A illustrates the gutter side 401 of attachment member 102. FIG. 4B illustrates the roof side 402 of attachment member 102. Attachment member 102 includes indentations 106A and 106B. In FIG. 4A, the indentations are concave (i.e., curved away from the viewer), and in FIG. 4B, the indentations are convex (i.e., curved towards the viewer). In this embodiment, the 106 indentations are narrower than corresponding 105 indentations, so that the 106 indentations can nest within the 105 indentations.

FIGS. 4A and 4B also illustrates holes 107A and 107B, which can be used to attach the gutter wedge and its associated gutter to a roof or roof fascia. Although 107A and 107B may appear perfectly aligned in FIGS. 4A and 4B, this is not necessarily the case. For example, 107A may be lower than 107B, so that a screw or nail used to attach the gutter wedge to the roof will be slanted upwards.

FIG. 4A also illustrates a spring tension clip 108. Spring clip 108 can help keep the gutter wedge in place while it is being permanently affixed. Some rain gutters have an indentation near the top on their roof-facing sides. When such indentations are present, spring clip 108 can fit over them to take advantage of that feature. Using a spring clip 108 can avoid the need for crimping or other attachment mechanisms that rely on permanent deformation. Until affixed via holes 107A and 107B, spring clip 108 allows gutter wedge 100 to be readily shifted with respect to a rain gutter prior to final placement.

The gutter side 401 of attachment member 102 may also be painted similarly to the underside 202 of support member 101. Assuming that support member 101 and attachment member 102 are formed as the result of folding a single sheet of metal, it may be easier to paint the entire face of a sheet of metal rather than just the portion that will form the underside 202 of support member 101. If folded to form gutter wedge 100, the underside 202 of support member 101 and the gutter side 401 of attachment member 102 will be from the same face of a sheet of metal. Moreover, to the extent that any side of attachment member 102 is visible from below, it will be the gutter side 401.

If combined to form the gutter wedge 100, as illustrated in FIG. 1, the roof side 402 of the attachment member 102, as shown in FIG. 4B, will face the gutter side 201 of the support member 101, as shown in FIG. 3A. Conversely, the gutter side 401 of the attachment member 102 shown in FIG. 4A will face away from the roof side 202 of the support member 101 shown in FIG. 3B. In this embodiment, a single sheet of metal is folded to form the shape of gutter wedge 100. Also, in this embodiment, the members are stamped together at attachment point 104 to maintain the desired shape.

Figure 5:
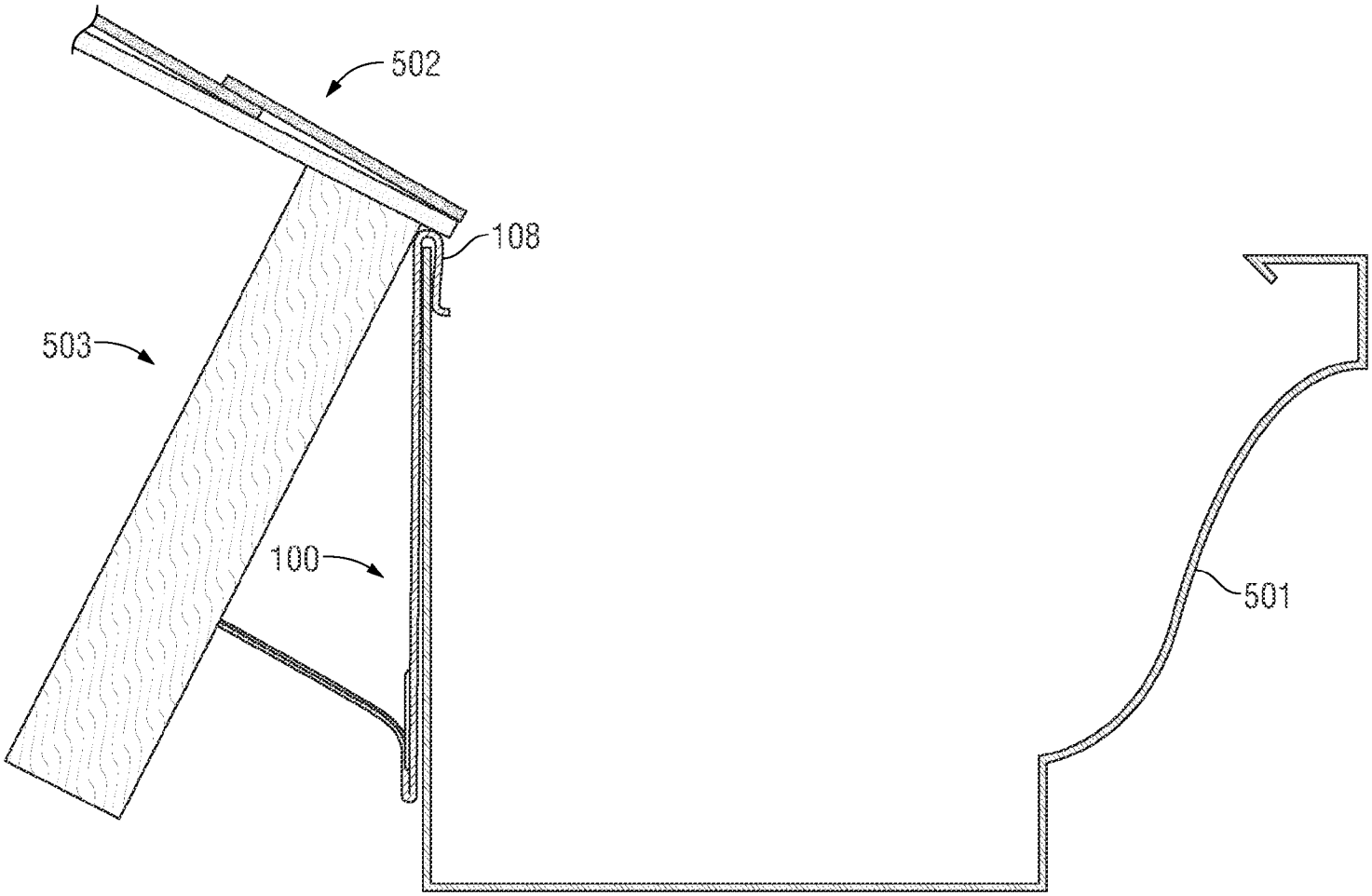
FIG. 5 is a profile illustration of an embodiment of an improved gutter wedge supporting a rain gutter.

FIG. 5 illustrates an embodiment of gutter wedge 100 configured to support a rain gutter 501 installed on to a roof 502 with a slanted fascia 503. In the example illustrated in FIG. 5, support member 101 has been cut to match the distance between the roof fascia and roof gutter at the point on gutter wedge 100 where the support member 101 is bent. Gutter wedge 100 is attached to rain gutter 501 partially using spring tension dip 108. Holes 107A and 107B have also been used in the attachment of rain gutter 501 and gutter wedge 100 to the roof fascia 502. In this embodiment, a nail is used to attach gutter 501 and gutter wedge 100 to slanted roof fascia 503 although those of skill will recognize that a variety of fasteners my be used for such applications.

Figure 2A:
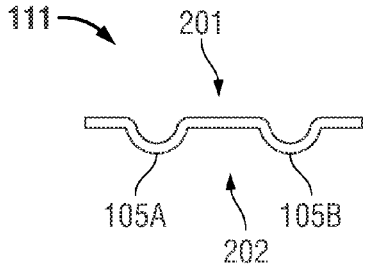
FIG. 2A illustrates the edge of a support member of an embodiment of a gutter wedge with improved performance.
Figure 2B:
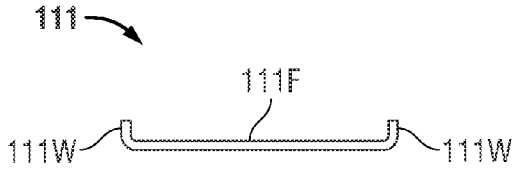
FIG. 2B depicts a support edge employed in an alternative embodiment.

FIG. 2A illustrates support edge 111 of support member 101 in a preferred embodiment. Support edge 111 is the terminal edge of support member 101 either as provided or after cutting or otherwise shortening support member 101 to a desired length. As illustrated in FIG. 5, support edge 111 is the portion of gutter wedge 100 that is in direct contact with roof fascia 503. Because support edge 111 has a corrugated profile with an undulating aspect as illustrated in FIG. 2A, it tends to resist lateral motion better than a straight profile. FIG. 2B is a depiction of an alternative profile for support edge 111 showing another configuration within the meaning of corrugated as used in this application. The profile of support edge 111 as shown in FIG. 2B presents a channel profile created from the linear floor 111*f* and extension walls 111*w*. This profile also tends to resist lateral motion better than a straight edge profile. As rain gutters may be subjected to high winds and other forces in addition to water shed from a roof, the ability to resist lateral movement provides useful advantages over other gutter wedges.

Because the support member 101 is substantially perpendicular to the roof fascia 503, as illustrated in FIG. 5, it is also substantially parallel to the forces that will act upon gutter wedge 100 when gutter 501 is under load by conveying large amounts of water. Also, in this configuration, support edge 111 will be in substantial contact against roof fascia 503 which provides a high degree of resistance to motion in all directions. In the case of softer roof fascia materials such as wood, support edge 111 will tend to "dig" into this material and avoid further shifting. In the case of harder fascia materials such as brick, support edge 111 will be positioned to provide the greatest resistance to lateral motion.

The nesting between indentations 105 and 106 provides resistance to twisting between support member 101 and attachment member 102. When support member 101 is comprised of an elastic material, the resistance provided by this elasticity provides additional resistance to shifting of rain gutter 501. Moreover, to the extent that gutter wedge 100 experiences any type of bending, it will return to its original shape provided that it experiences no plastic deformation. Those of skill will appreciate that the indentations 105 and 106 can extend all the way to support edge 111 or may end before the terminus of support member 101. It should also be appreciated that indentations along support member 101 may number from one to many. Further, indentations on both support member 101 and member 102 may "nest" along coincident area 112 to provide further strength to the structure of the gutter wedge.

Although, the embodiment illustrated in FIG. 1 is applicable to a larger number of gutter/roof combinations that known gutter wedges, some degree of variability may be desirable. This can be accomplished by varying the location of the bend 112 and the angle of the bend 113.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An adjustable gutter wedge configured for disposition at least in part between the back wall of a gutter and fascia board, the gutter wedge comprising:

a substantially rectangular elastic material folded at an attachment edge to form a support member arm and an attachment member arm, said support member arm and said attachment member arm extending from the attachment edge and parallel with each other at least until an attachment point between the attachment member arm and support member arm, said attachment point being an indentation that protrudes into the attachment member arm and the support member arm and which attachment point is configured to prevent unfolding of the support member are from the attachment member arm and beyond which attachment point the attachment member arm and the support member arm diverge and the attachment member arm comprising on one side, a gutter facing surface and, on its other side, fascia-facing surface, the attachment member arm being securable to the back wall of the gutter; and the support member arm being configured so as to be closer to the facia-facing surface than the gutter facing surface of the attachment member arm, the support member arm projecting at an acute angle from the attachment member arm toward the fascia board, the support member arm having a distal end configured to abut the fascia board.

2. The adjustable gutter wedge of claim 1 in which the elastic material is comprised of metal.

3. The adjustable gutter wedge of claim 1 in which the elastic material is comprised of steel.

4. The adjustable gutter wedge of claim 1 comprised from stamped metal.

5. The adjustable gutter wedge of claim 1, wherein the attachment member arm has a spring tension clip to secure the back wall of the gutter.

6. The adjustable gutter wedge of claim 1, wherein the support member arm is trimmed along score markings in the support member arm to accommodate a pitch of the fascia board.

7. An adjustable gutter wedge configured for disposition at least in part between the back wall of a gutter and fascia board, the gutter wedge comprising:

an attachment member arm comprised of elastic material and comprising on one side, a gutter facing surface and, on its other side, a fascia-facing surface, the attachment member arm being securable to the back wall of the gutter and having a lower attachment edge; and a support member arm that runs parallel to the attachment member arm from the lower attachment edge at least until an attachment point between the attachment member arm and the support member arm, the support member arm being disposed so as to be closer to the fascia-facing surface than the gutter facing surface of the attachment member arm while projecting at an acute angle from the attachment member arm toward the fascia board so as to diverge away from the attachment arm member beyond the attachment point, the support member arm having a distal end configured to abut the fascia board, the support member arm being corrugated to resist lateral motion and the attachment member arm having corrugations that mate with corrugations of the support member arm.

8. The adjustable gutter wedge of claim 7 in which the support member arm and the attachment member arm are comprised of metal.

9. The adjustable gutter wedge of claim 7 comprised from stamped metal.

10. The adjustable gutter wedge of claim 7, wherein the attachment point attaches the support member arm to the attachment member arm at a point where the support member arm is parallel to the attachment member arm.

11. The adjustable gutter wedge of claim 7 wherein the attachment member arm has a spring tension clip to secure the back wall of the gutter.

12. The adjustable gutter wedge of claim 7, wherein the support member arm is trimmed along score markings in the support member arm to accommodate a pitch of the fascia board.

13. An adjustable gutter wedge configured for disposition at least in part between the back wall of a gutter and fascia board, the gutter wedge comprising:

an attachment member arm comprised of elastic material and comprising on one side, a gutter facing surface and, on its other side, a fascia-facing surface, the attachment member arm being securable to the back wall of the gutter and having a lower attachment edge; and a support member arm that runs parallel to the attachment member arm from the lower attachment edge at least until an attachment point between the attachment member arm and the support member arm, the support member arm being disposed so as to be closer to the fascia-facing surface than the gutter facing surface of the attachment member arm while projecting at an acute angle from the attachment member arm toward the fascia board so as to diverge away from the attachment arm member beyond the attachment point, the support member arm having a distal end configured to abut the fascia board, the support member arm being corrugated to resist lateral motion and the attachment member arm having corrugations that mate with the corrugations of the support member arm.

* * * * *